United States Patent [19]

Kroetch et al.

[11] Patent Number: 4,928,442

[45] Date of Patent: May 29, 1990

[54] INFLATABLE TENTS

[76] Inventors: Keith Kroetch; Colleen Fitzpatrick, both of 1725 N. Fairmont Loop, Coeur D'Alene, Id. 83814

[21] Appl. No.: 349,483

[22] Filed: May 9, 1989

[51] Int. Cl.[5] ..... E04H 15/20

[52] U.S. Cl. ..... 52/2 J

[58] Field of Search ..... 52/2 H, 2 J, 2 N, 2 P, 52/2 K, 101, 106

[56] References Cited

U.S. PATENT DOCUMENTS

| | | | |
|---|---|---|---|
| 3,008,214 | 11/1961 | Foster et al. | 52/2 H X |
| 3,055,379 | 9/1962 | Fink | 52/2 H |
| 3,415,719 | 12/1968 | Telkes | 52/2 J X |
| 4,000,585 | 1/1977 | Denaro | 52/2 |
| 4,197,681 | 4/1980 | Holcombe | 52/2 |
| 4,271,642 | 6/1981 | Karr | 52/2 |
| 4,558,543 | 12/1985 | Kitamura et al. | 52/2 N |
| 4,631,873 | 12/1986 | Parish | 52/2 J |

*Primary Examiner*—John E. Murtagh
*Assistant Examiner*—Lan Mai
*Attorney, Agent, or Firm*—Terry M. Gernstein

[57] ABSTRACT

An improvement in inflatable tents includes a mattress element that has a manifold system for inflating that mattress element and fluid check valves that co-operate with fluid check valves on various accessory items to inflate such accessory items via the mattress manifold system. Attaching means are located on the mattress element and on the accessories to releasably couple various accessory items to the mattress element. The mattress thus can be used as a raft, as a bottom to various types of tents and the like.

1 Claim, 2 Drawing Sheets

INFLATABLE TENTS

TECHNICAL FIELD OF THE INVENTION

The present invention relates to the general art of camping devices, and to the specific field of inflatable tents.

BACKGROUND OF THE INVENTION

The sports of camping, back-packing and hiking have long enjoyed tremendous popularity. These sports often include an overnight stay out-of-doors which requires some form of sleeping set up. These sleeping set ups often include a mattress and some type of covering element, such as a tent or the like.

The art of tents is quite old and is so well developed as to include a plethora of various tent designs.

However, in recent times, there has been a further demand for a tent that is easily stored, carried and set up. Such a requirement has led to still further tent designs, including the so-called inflatable tent which is stored in a deflated configuration and is then inflated for use. As before, the art of inflatable tents is also quite well developed.

While all of these myriad of tent designs has proved to be somewhat successful, there is still at least one problem with such known tents that has vitiated the complete commercial success of such tents. This problem arises due to the varied demands now being placed on tents by the increased popularity of the above-mentioned out-door sports. For example, a camper may be required to cross a river, sleep on uneven terrain, sleep in varied weather conditions, and yet travel great distance over difficult terrain—all on the same outing.

To be most comfortable, this camper should carry several tent designs. However, as will be evident, such a solution is not practical. Therefore, the tent design should be as versatile as possible.

However, heretofore known tents simply are not versatile enough to fully meet all of the above-described needs in an efficient manner. As an example of this, a tent, even an inflatable tent, simply does not make an effective raft, and a covered tent may not be desirable in certain situations.

Accordingly, there is a need in the camping art for a camping device that is adaptable for use in a wide variety of situations and conditions.

OBJECTS OF THE INVENTION

It is a main object of the present invention provide a camping device that is adaptable to a wide variety of situations and conditions.

It is another object of the present invention to provide a camping device which can be used in a variety of situations in the manner of a tent.

It is another object of the present invention to provide a camping device which can be used in a variety of stiuations in the manner of a mattress.

It is another object of the present invention to provide a camping device that can be used in the manner of a raft.

It is another object of the present invention to provide a camping device which can be used in the manner of a wide variety of tents.

SUMMARY OF THE INVENTION

These, and other, objects are achieved by a mattress element that has means for inflating it as well as various accessories via such mattress. The mattress is also provided with means for attaching such accessories thereto.

The mattress can thus be used as a raft, an uncovered mattress, or as a bottom element of a variety of different types of tents. The mattress includes a manifold system and a plurality of one-way check valves with each of the accessories including a manifold system and a check valve which mates with the mattress check valve to conduct air to the accessory via the mattress. The accessories can include tent-like covers, sleeping bag-like covers and the like.

DETAILED DESCRIPTION OF THE PREFERRED EMBODIMENT OF THE INVENTION

Figure 1:
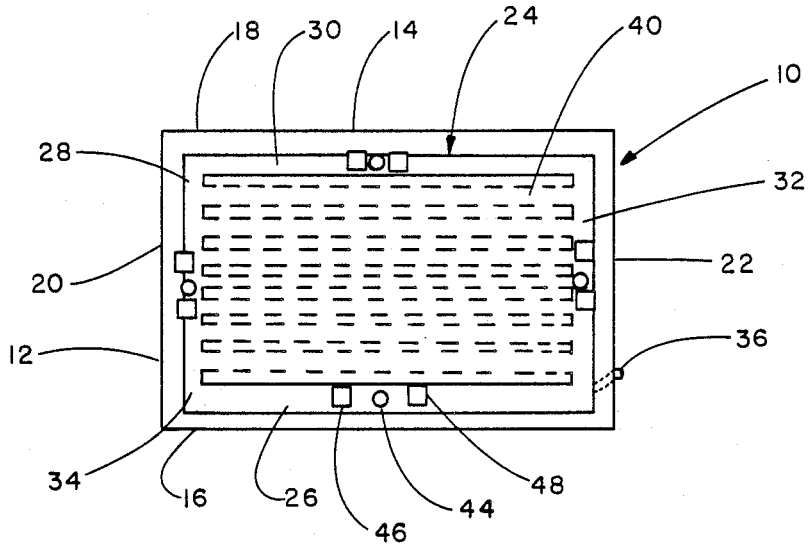
FIG. 1 is a plan view of a mattress-like element embodying the present invention.

Shown in FIG. 1 is a mattress element 10 which is adapted for use as a floatable device, such as a raft, as a bottom of a tent, or as a sleeping bag-like element, or the like. The mattress element 10 includes a ground-engaging surface (not seen in FIG. 1), a user-supporting surface 12 which are connected together by side walls 14 and 16 and end walls 18 and 20. The mattress element 10 is formed of flexible material common to inflatable tents, such as plastics-type or rubber-type materials, or the like to be collapsible into a small storable configuration. The surfaces and walls co-operate to define an interior chamber inside the mattress 10.

The mattress element 10 includes an inflation system 24 inside of the chamber to move that mattress from a collapsed configuration into a usable configuration. The inflation system includes a plurality of mattress element manifold conduits 26, 28, 30 and 32, all of which are fluidically interconnected together as indicated at fluid connection 34 between manifolds 26 and 28. An inflation stem 36 is mounted on the mattress and is fluidically connected to manifold 30 to conduct air from a source (not shown) into the manifold system.

A multiplicity of inflating conduits, such as conduit 40, are each fluidically connected to the manifolds 28 and 32 to receive air therefrom in an inflation process.

The mattress also includes a one-way check valve, such as valve 44, associated with each manifold. Each check valve can also include a ball or like element to maintain such valve closed to keep the inflation system 24 closed and sealed in normal use. Each check valve is mounted on the mattress to extend upwards from the user-supporting surface 26 for a function that will be fully discussed below.

Adjacent to each check valve are accessory mounting elements, such as elements 46 and 48 adjacent to the check valve 44. The accessory mounting elements are located on the usersupporting surface and can include snap fasteners, hook and loop fasteners or like releasable connecting means. The accessory mounting elements will also be fully discussed below. Other accessory mounting elements can be included on other areas of the mattress, such as on the bottom, on the sides or on the ends a necessary.

Figure 2:
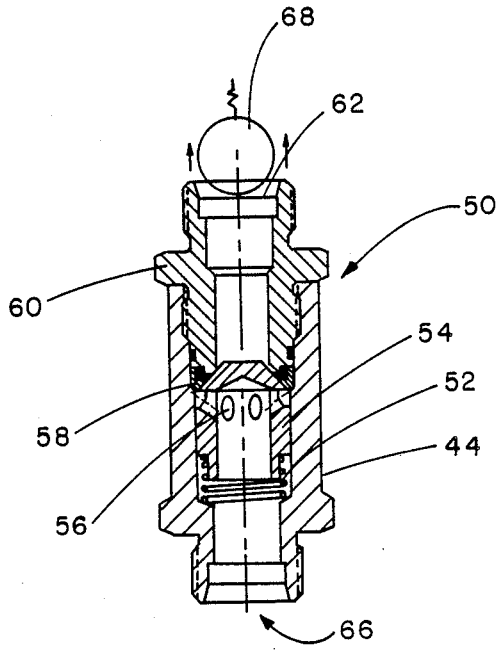
FIG. 2 is a cutaway elevational view of a check valve used in the device embodying the present invention.

A valve system 50 is shown in FIG. 2, and attention is now adverted to such Figure. The valve system 50 includes the mattress-mounted check valve, such as valve 44, and operates as a pressure controlled valve. That is, the valve system in an in-line type check valve and includes a spring 52 which urges a poppet 54 toward a position which places orifices 56 in position to be closed by a land-like element 58. The accessory includes a check valve 60 mounted thereon, and when this valve 60 is mated with the mattress check valve, the accessory check valve moves the poppet 54 downwardly against the spring force and away from the land-like element 58 thereby opening the flow path 62 for air to flow from the mattress manifold system into the accessory as indicated by the arrow 66 in FIG. 2. A spring-biased ball element 68 can also be included in the accessory to further prevent backflow from the accessory into the mattress.

The fastening means 46 and 48 assist the check valves in remaining in place and in the fluidically coupled configuration shown in FIG. 2. As air is pumped into the mattress via the valve 36, it will fill the manifold system and the inflation conduits of the mattress, and will move via the check valves into an accessory mounted on the mattress by the attaching means, such as means 46 and 48.

Figure 3:
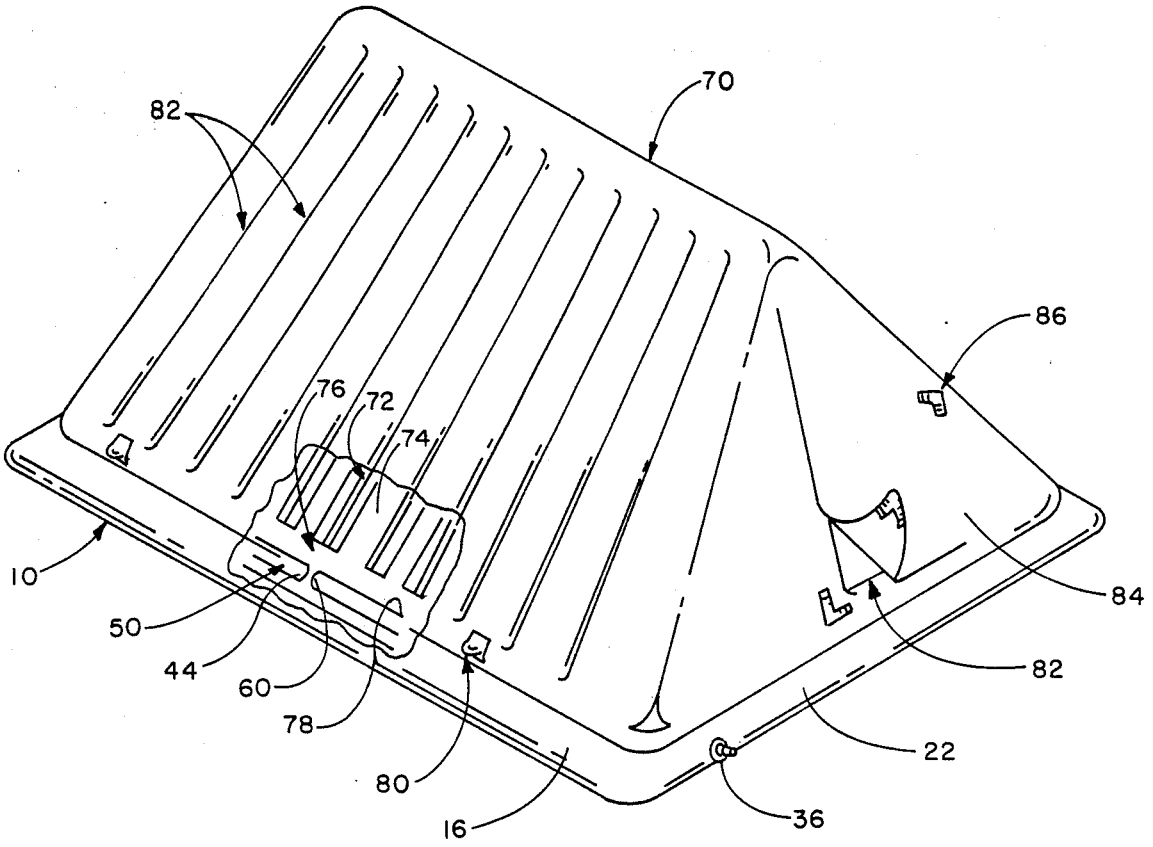
FIG. 3 is a partially cutaway perspective view of a covered tent form of the present invention.

The mattress 10 can thus be used in the manner of a mattress, a raft, or the like. It can also be used in conjunction with a tent-like cover to form a tent structure as shown in FIG. 3. The accessory 70 thus includes its own inflation system 72 having a multiplicity of accessory inflating conduits, such as conduit 74 extending therethrough and fluidically connected to an accessory manifold system 76. The accessory manifold system includes a manifold, such as manifold 78 located along each edge thereof, and an accessory check valve, such as valve 60 is mounted on the accessory to fluidically connect such accessory manifold 78 to the mattress manifold system as above described. Adjacent to each of the accessory check valves are mattress attaching means which co-operate with the above-described accessory attaching means on the mattress to hold the accessory in place as indicated in FIG. 3. Additional mounting means, such as anchor cleats 80, or the like can also be included to further ensure the secure mounting of the accessory on the mattress. The accessory inflating conduits are separated by pleats 82 or the like.

The tent-like accessory 70 can include an entrance section 82 formed by flaps 84 that can be held in an open condition by fastener means 86.

The conical shape shown in FIG. 3 is merely an example of the shapes that can be used in conjunction with the mattress 10, and other shapes, such as a geodesic shape can also be used when the mattress is suitably modified.

Figure 4:
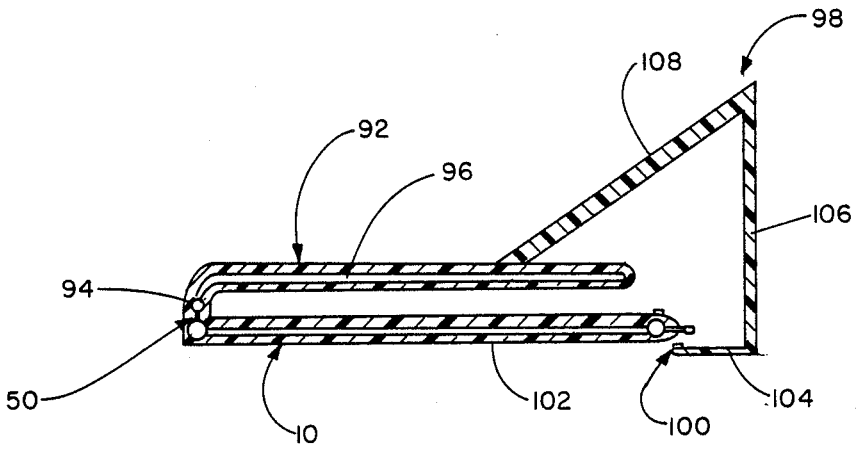
FIG. 4 is a partially cutaway elevational view of a sleeping bag-like form of the present invention.

A sleeping bag-type configuration 90 is shown in FIG. 4. The configuration 90 uses the mattress 10 and an accessory 92 that is shaped like a top portion of a sleeping bag. The accessory 92 includes a manifold 94 and a plurality of inflation conduits, such as conduit 96, fluidically connected thereto. The manifold 94 is fluidically connected to the mattress inflation system by the valve system 50 as above discussed.

A head-covering section 98 is also included and can be attached to the mattress by fastener means 100 on ground-engaging surface 102 of the mattress, and can include a mounting base 104, an upright section 106 and a flexible cover 108, formed of water repelling material, such as plastics-type material, or the like. Netting can also be used in the section 108 if suitable.

As can be seen from the foregoing, the mattress 10 is amenable for use with a wide variety of different accessories or it can be used by itself. Thus, great versatility is provided.

It is to be understood that while certain forms of the present invention have been illustrated and described herein, it is not to be limited to the specific forms or arrangements of parts described and shown.

We claim:

1. An inflatable tent comprising:

a rectangular mattress element which includes (1) a ground-engaging surface, (2) a user-supporting surface, (3) first and second sides and first and second end walls connecting said surfaces together to define a closed compartment having a chamber therein, (4) a mattress manifold system located in said chamber and being adapted to hold air for inflating said mattress element and which includes (a) a first manifold extending adjacent and parallel to said first end wall and including a first mattress-mounted check valve fluidically connected thereto and having an inflation stem fluidically connected thereto, (b) a second manifold extending adjacent and parallel to said first side wall and being fluidically connected to said first manifold and including a second mattress-mounted check valve fluidically connected thereto, (c) a third manifold extending adjacent and parallel to said second end wall and including a third mattress-mounted check valve fluidically connected thereto and being fluidically connected to said second manifold, and (d) a fourth manifold extending adjacent and parallel to said second side wall and including a fourth mattress-mounted check valve fluidically connected thereto and being fluidically connected to said first end manifold and to said third manifold, (5) an air inlet valve fluidically connected to said first manifold inflation stem and mounted on said mattress element for conducting air from a source into said first manifold, (6) a plurality of air conduits each connected to said first and third manifolds to receive air therefrom to inflate said mattress element, said air conduits being spaced apart from each other and extending parallel to each other and parallel to said second and fourth manifolds, and being connected together only via said first and third manifolds, (7) each mattress element check valve of said mattress element check valves having means for normally closing said each mattress element check valve and including (a) an in-line check valve having a casing mounted on said mattress element, (b) a poppet slidably mounted in said casing and having a plurality of orifices defined therein, (c) a land element on said casing to close said orifices when said poppet is in a first position, and (d) a spring urging said poppet towards said first position, (8) accessory attaching means mounted on said mattress element adjacent to each mattress element check valve; and (9) a user-covering accessory which includes (a) an accessory manifold, (b) a plurality of accessory air conduits each fluidically connected to said accessory manifold to receive air therefrom to inflate said accessory, (c) an accessory check valve fluidically connected to said accessory manifold to conduct air into said accessory manifold, and (d) means on said accessory check valve to releasably couple said accessory check valve to one mattress element check valve of said mattress element check valves, and which includes (i) a body which is sized to slidably fit into said one mattress element check valve casing to engage the check valve poppet of said one mattress element check valve and move that poppet away from said first position when pressed into the casing of said one mattress element check valve, and (ii) a back-flow preventing ball on said body and which includes a spring biasing said ball into said body to prevent flow of air from said accessory manifold into said mattress manifold system, and (e) mattress element attaching elements mounted on said accessory adjacent to each accessory check valve for releasably coupling said accessory to said mattress element, and

(10) said user-covering accessory including a portion covering a user's head.

* * * * *